United States Patent [19]

Kruse

[11] 4,177,137

[45] Dec. 4, 1979

[54] AROMATICS EXTRACTION PROCESS

[75] Inventor: Larry W. Kruse, Strongsville, Ohio

[73] Assignee: Standard Oil Company, Cleveland, Ohio

[21] Appl. No.: 849,299

[22] Filed: Nov. 7, 1977

[51] Int. Cl.[2] ..... C10G 21/28

[52] U.S. Cl. ..... 208/321; 208/333; 203/26

[58] Field of Search ..... 208/321, 333

[56] References Cited

U.S. PATENT DOCUMENTS

| | | | |
|---|---|---|---|
| 2,616,912 | 11/1952 | Dickinson | 208/321 |
| 2,723,940 | 11/1955 | Fenske et al. | 208/321 |
| 3,207,692 | 9/1965 | Kleef et al. | 208/321 |
| 3,470,088 | 9/1969 | Vickers | 208/321 |
| 3,475,329 | 10/1969 | Little et al. | 208/321 |

*Primary Examiner*—Herbert Levine

*Attorney, Agent, or Firm*—David J. Untener; Herbert D. Knudsen; Larry W. Evans

[57] ABSTRACT

Substantial energy savings are realized in an aromatic extraction process wherein a vapor sidestream is removed from the solvent stripper, compressed and used to provide the heat necesary for distillation in the solvent stripper.

8 Claims, 2 Drawing Figures

AROMATICS EXTRACTION PROCESS

BACKGROUND OF THE INVENTION

Solvent extraction is a well known method for recovery of aromatic hydrocarbons from a mixed hydrocarbon stream. Typically, such a hydrocarbon stream fed to an aromatics process will contain aromatic hydrocarbons such as benzene, toluene and xylenes. The relative amounts of each of these aromatic components found in the stream to be treated can be varied by the proper choice of the boiling range of the petroleum fraction subjected to solvent extraction. There are also processes that will convert other portions of the hydrocarbon stream to aromatics prior to being sent to the aromatics extraction process.

The extraction process consists of two basic columns. An extraction column contacts a solvent with the particular petroleum fraction containing aromatics. The solvent extracts the aromatics from the feed stream, and is then sent to a stripping column. In the stripping column the aromatics are removed from the solvent and the solvent is recycled back to the extraction column for reuse.

Typical solvents useful in this process are sulfolane or glycols. Diethylene glycol, dipropylene glycol or tetraethylene glycol have been used in the prior art. A description of a process using tetraethylene glycol can be found in the *Oil and Gas Journal*, Jan. 7, 1974, pages 2–5.

It has been discovered that substantial energy savings can be realized in the heat necessary to strip the aromatics from the solvent by using the present invention.

SUMMARY OF THE INVENTION

In the process for the recovery of aromatics from a petroluem fraction containing aromatics, comprising a first column wherein a solvent is contacted with the petroleum fraction to extract aromatics therefrom, and a second column wherein the aromatics are stripped from the solvent, the improvement comprising removing a vapor stream from the upper half of the second column, compressing said sidestream, and passing said compressed sidestream in indirect heat exchange with the second column to provide at least part of the heat necessary to strip the aromatics from the solvent.

The invention is best understood by reference to the drawings.

DESCRIPTION OF THE DRAWINGS

Referring to FIG. 1, a petroleum fraction containing aromatics enters extraction column 102 through line 100. A suitable solvent capable of extracting the aromatics enters the top of the extraction unit through line 104 and passes countercurrent to the petroleum fraction. The rich solvent containing aromatics is removed from the bottom of column 102 through line 108, and is then passed to stripping column 110. The remaining petroleum fraction without the aromatics, commonly called the raffinate, leaves the overhead of the extraction column through line 106.

Figure 1:
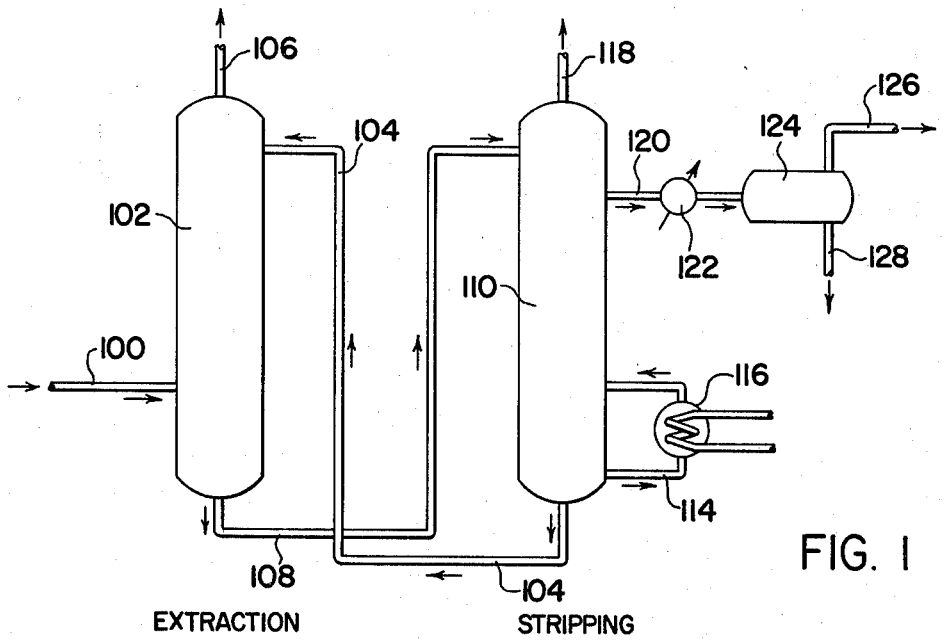
FIG. 1 shows a typical aromatics extraction process.

In stripping column 110 the aromatics are removed from the solvent. A portion of the bottoms of this column is passed through line 114 to indirect heat exchanger 116. This stream is then heated indirectly, usually with steam. The heated stream is then fed back to the distillation column to provide the heat necessary for stripping.

Aromatics-free solvent is removed from the bottom of column 110 through line 104 and is recycled back to the extraction column for reuse. An overhead gas stream containing some aromatics, solvent and water is removed from the stripping column through line 118. This stream may be condensed, the water removed in a separator, and the stream recycled back to the extraction column.

A vapor sidestream is removed from the upper half of the column and passes through line 120 to condenser 122. Here the stream is condensed and passed to water separator 124. Water is removed as a bottoms stream 128 and the solvent free-water free aromatics removed from the separator through line 126. This stream is then typically sent to a water wash and the various units necessary to perform the final separation of the specific aromatics.

Figure 2:
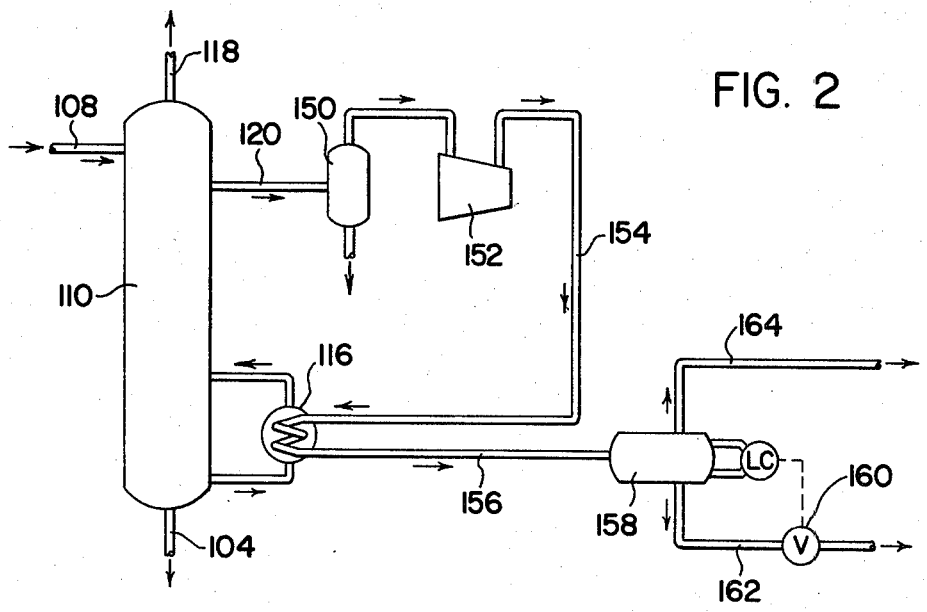
FIG. 2 shows the stripping column of the invention.

FIG. 2 shows an embodiment of the present invention as applied to the stripping column of FIG. 1. The solvent containing aromatics enters stripping column 110 through line 108. As in FIG. 1, a vapor overhead stream is removed through line 118 and the aromatics-free solvent is removed from the stripping column bottoms through line 104 and recycled back to the extraction column.

A vapor sidestream is removed through line 120 and passes to separator 150. Separator 150 allows any condensibles to be removed prior to the gas stream being compressed. The liquid-free gas stream passes from the separator to compressor 152 wherein the vapors are compressed. The compressed vapors exit the compressor in line 154 and pass to indirect heat exchanger 116.

In exchanger 116, the compressed vapors are cooled and their condensation transfers heat to the stripper. Total condensation in this exchanger is not necessary, but is preferred. The at least partially condensed stream then exits the exchanger through line 156 and may be sent to separator 158.

Separator 158 provides a control system to insure that at least partial condensation will take place in exchanger 116. Small amounts of vapors can be removed at a fixed rate through conduit 164. The only manner in which the remaining compressed vapors can exit the system is by condensing and passing through conduit 162. A level control system controls the amount of liquid leaving separator 158. If sufficient condensation has not taken place, control valve 160 will close thereby increasing the pressure on the system. The increased pressure will increase the rate of condensation in exchanger 116 and thereby condense a greater portion of the compressed vapor stream.

DESCRIPTION OF THE PREFERRED EMBODIMENTS

The feed to the aromatics extraction process normally consists of $C_6$–$C_{12}$ hydrocarbons. A description of the various types of petroleum fractions containing aromatics can be found in *The Encyclopedia of Chemical Technology*, 2nd. edition, vol. 3, page 376. The present invention is applicable to these various feeds as long as a solvent is used to extract the aromatics, followed by solvent stripping.

In the extraction column, the petroleum fraction is contacted countercurrently with the solvent. The pressure and temperature used in this column depends on the specific feed and the specific solvent used. One of skill in the art is well aware of these parameters when designing a specific extraction column.

Preferred solvents useful in the present invention are glycols. The solvent is typically fed to the top of the extraction column with the solvent containing aromatics being removed as a liquid bottoms stream. The remaining hydrocarbons now free of aromatics, is called the raffinate and is removed as a liquid overhead stream from the extraction column.

The solvent containing aromatics is then sent to a stripping column wherein heat is used to separate the aromatics from the solvent through distillation. Lean solvent free of aromatics is removed from the bottom of the stripping column and recycled back to the extraction column for reuse. The aromatics are removed as a vapor sidestream, condensed and then sent to further processing. The overhead of the stripper can also be condensed. This stream will contain some water which should be separated from the condensed overhead before the condensed overhead is recycled back to the extraction column.

The pressures and temperatures of the stripping column again depend on the type of solvent used. Further, the temperature necessary for distillation will also depend upon the composition of the aromatics being extracted. Such systems may be extracting one specific aromatic like benzene, or a complete range of aromatics such as benzene, toluene and xylenes.

In the present invention, a vapor sidestream, preferably the vaporous aromatic product stream, is compressed to a pressure of from 100 to about 300 psig. Preferred is a pressure of about 150 psig. This pressure should be sufficient such that at least part of the compressed vapor stream will condense during heat exchange, since the majority of the heat transferred is from condensation.

It is to be noted that not all of the heat necessary for distillation in the stripping column can be provided by this stream. Some external heat will be necessary. However, reductions of from about 10–40% of the external heat used can be realized. This amount of heat is a significant energy savings on large scale industrial processes.

EXAMPLE

A stream containing aromatics and a glycol solvent is passed to a solvent stripper operating at 4 psig. A vapor sidestream containing aromatics is removed from the stripper and compressed to 125 psig. At this pressure, the compressed vapor stream has a temperature of 418° F. The compressed vapors are then sent to indirect heat exchange with a portion of the liquid in the bottom of the stripping column.

Approximately 40% of the heat necessary for distillation in the stripping column is supplied by the compressed vapor stream. The energy required for operating the compressor is approximately 11% of the total heat requirements for the stripping column. Thus a net reduction of 29% in energy usage is achieved through the present invention.

I claim:

1. In the process for recovery of aromatics from a petroleum fraction containing aromatics, comprising a first column wherein a solvent is contacted with the petroleum fraction to extract aromatics therefrom, and a second column wherein the aromatics are stripped from the solvent, the improvement comprising removing a vapor sidestream containing aromatics from the upper half of the second column, compressing said sidestream containing aromatics, and passing said compressed sidestream in indirect heat exchange with the second column to provide at least part of the heat necessary to strip the aromatics from the solvent.

2. The process of claim 1 wherein the vapor sidestream is compressed to a pressure sufficient to condense at least a portion of said vapor sidestream during indirect heat exchange.

3. The process of claim 1 wherein the solvent is a glycol.

4. The process of claim 1 wherein the aromatics to be recovered are selected from the group consisting of benzene, toluene, xylenes or mixtures thereof.

5. The process of claim 2 wherein the vapor sidestream is compressed to a pressure of about 100 to 300 psig.

6. The process of claim 5 wherein the vapor sidestream is compressed to a pressure of about 125 to 200 psig.

7. The process of claim 2 wherein the at least partially condensed vapor sidestream after heat exchange is sent to a separator wherein a vapor phase is removed overhead and a liquid phase is removed from the bottom.

8. The process of claim 7 wherein level control is maintained in said separator by controlling the amount of liquid removed from said separator, thereby varying the pressure of the compressed vapor sidestream to achieve condensation in the indirect heat exchanger.

* * * * *